United States Patent [19]

Mou

[11] Patent Number: 5,003,974

[45] Date of Patent: Apr. 2, 1991

[54] FIRST-AID GAS MASK

[76] Inventor: Lin-Her Mou, Fl. 5, No. 6, Lane 394, Long Chang Rd., Taipei, Taiwan

[21] Appl. No.: 427,494

[22] Filed: Oct. 27, 1989

[51] Int. Cl.[5] ..... A62B 7/10

[52] U.S. Cl. ..... 128/201.25; 128/205.12; 128/205.27

[58] Field of Search ..... 28/200.27, 200.28, 201.15, 28/201.24, 201.25, 205.27, 205.29, 206.12, 205.12

[56] References Cited

U.S. PATENT DOCUMENTS

| | | | |
|---|---|---|---|
| 1,262,566 | 4/1918 | Rhodes et al. | 128/201.25 |
| 1,945,919 | 2/1934 | Seijo | 128/201.29 |
| 2,262,522 | 11/1941 | Yant et al. | 128/200.27 |
| 2,896,617 | 7/1959 | Gibbons | 128/200.27 |
| 3,525,334 | 8/1970 | Braman | 128/201.25 |
| 3,736,927 | 6/1973 | Misaqi | 128/201.25 |
| 4,233,972 | 11/1980 | Hauff et al. | 128/200.28 |
| 4,350,507 | 9/1982 | Greenough et al. | 128/201.25 |
| 4,572,178 | 2/1986 | Takase et al. | 128/201.25 |
| 4,590,951 | 5/1986 | O'Connor | 128/205.12 |
| 4,815,458 | 3/1989 | Sing | 128/201.25 |

*Primary Examiner*—Edgar S. Burr
*Assistant Examiner*—Aaron J. Lewis
*Attorney, Agent, or Firm*—Morton J. Rosenberg; David I. Klein

[57] ABSTRACT

The present invention is to provide a kind of first-aid gas mask, which uses an air filter to filtrates toxic gas and to further let the well filtrated gas be delivered to the transparent cover around the mouse and nose of the user for inhalation, which transparent cover is having an elastic band made on the bottom opening for fastening, through which bottom opening the exhalation is exhausted. This invention is easy to operate and practical for use in first-aid and, more particularly for use in emergent case during fire or pit disaster so as to help the user to escape with one's life.

1 Claim, 5 Drawing Sheets

FIRST-AID GAS MASK

BACKGROUND OF THE INVENTION

The present invention is to provide a kind of fist-aid gas mask which is comprised of a transparent cover and an air filter. During dire or any other emergent condition, the transparent cover is put on one's head to let the air filter filtrate toxic gas so as to help one escape with one's life.

In daily news, disaster is constantly reported everywhere in the world. It is more terrible to encounter fire or pit accident. According to reports, many victims of disasters were choked to lose consciousness by carbon-oxide or toxic gas on the scene and come to a band end.

The main object of the present invention is to help people keeping to respire normally so as to escape with one's life from the scene of a disaster.

The other objects, features and advantages of the present invention will become more apparent from the following detailed description considered in connection with the annexed drawings as hereunder.

BRIEF DESCRIPTION OF THE DRAWINGS

FIG. 2 is a fragmentary view of an air filter according to the present invention.

CODES (1) Transparent cover, (11) Cover, (12) Elastic band, (13) Flap, (14) Male snap fastener, (15) Ring, (16) Notch, (2) Rectangular case, (21) Flap, (22) Female snap fastener, (23) Air outlet hole, (24) Battery chamber, (25) Motor room, (26) Vane wheel room, (27) Filter room, (28) Draft chamber (29) Draft hole, (3) Motor, (31) Motor seat, (32) Motor shaft, (4) Vane wheel, (41) Center hole, (5) Shell, (6) Filter box, (7) Battery, (8) Flexible air pipe, (81) Connecting end, (82) Air outlet hole, (9) Protective case, (91) Round hole, (92) Flap, (93) Fastener means.

DETAILED DESCRIPTION OF THE PREFERRED EMBODIMENT

Figure 1A:
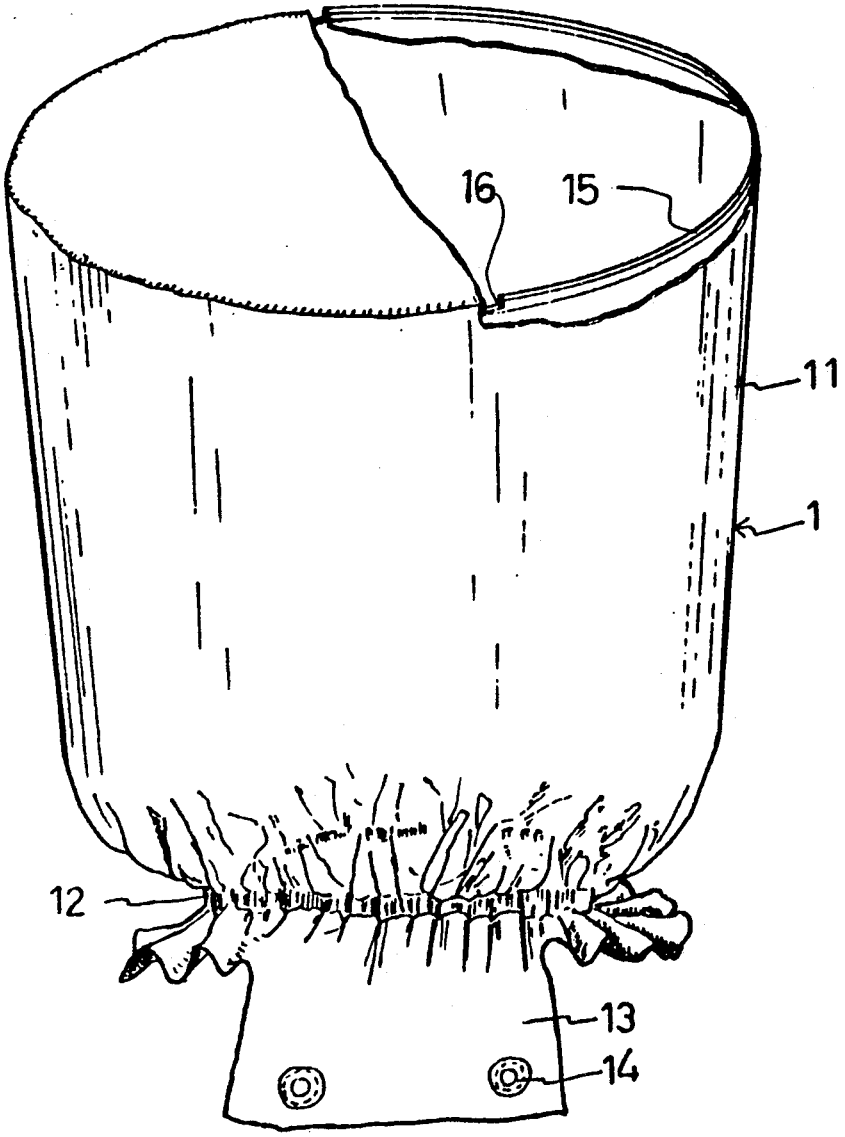
FIGS. 1-A and 1-B illustrate a transparent cover according to the present invention.
Figure 1B:
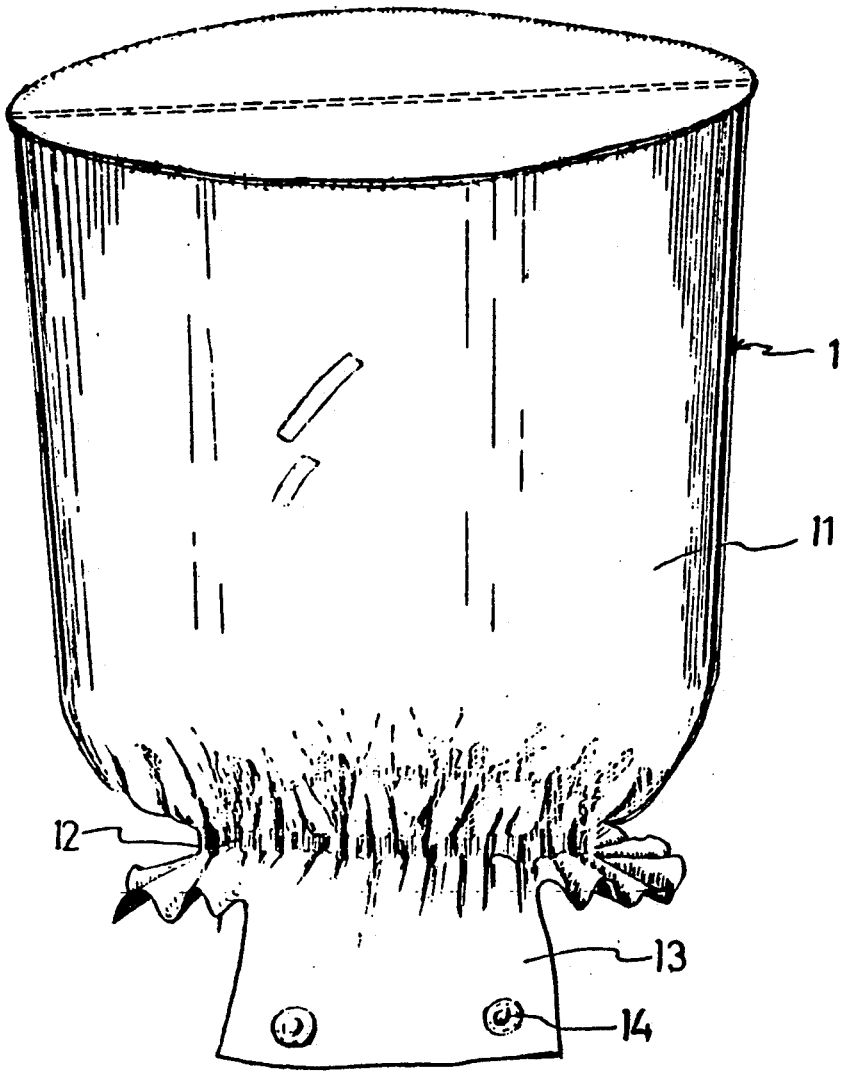
Figure 1:
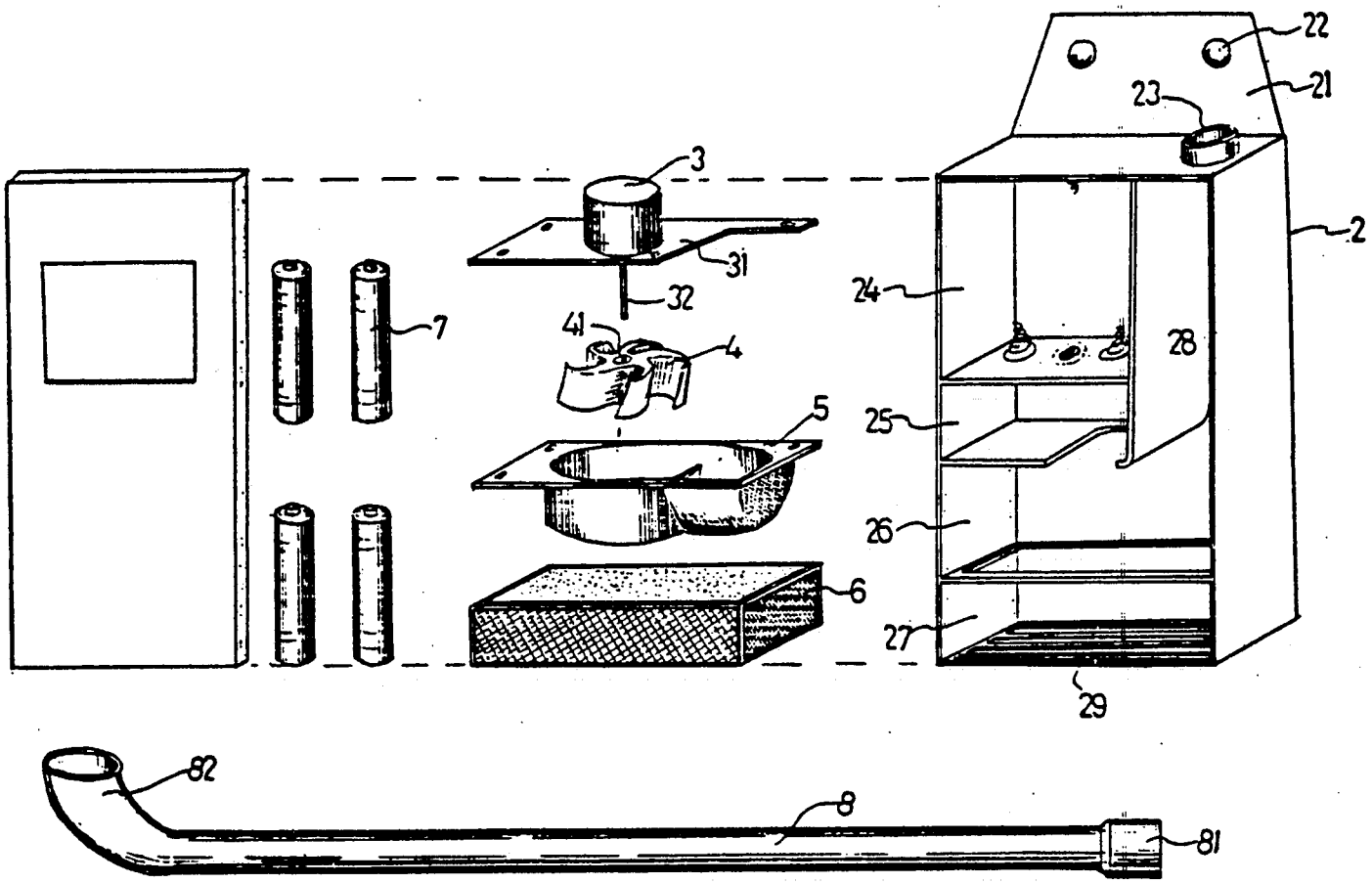

Referring to FIGS. 1 and 2, a gas mask is including a transparent cover (1); an active carbon air filter which is comprised of a rectangular case (2), a motor (3), a vane wheel (4), a shell (5), a filter box (6) having wire filter element, and batteries (71); and a flexible air pipe (8). The transparent cover (1) is comprised of a rigid ring (15) having two opposite notches (16) made thereon, and a heat-resisting soft and transparent cover (11) having a bottom opening with an elastic band (11) made thereon for fastening. A rectangular flap (12) is extended from the bottom end of the transparent cover (11) with two male snap fasteners (13) made thereon to fasten up with the two female snap fasteners (22) of the flap (21) of the rectangular case (2).

As an alternate form to eliminate the rigid ring (15), the transparent cover (1), as shown in FIG. 1-B, may have a thicker top portion made of heat resisting resin with an elongated groove made thereon through which elongated groove the cover (1) can be easily folded up for collection.

The rectangular case (2) of the air filter is having an inner space divided into a battery chamber (24) for setting therein of four pieces of batteries (7); a motor room (25) below the battery chamber (24) for setting therein of the motor (3) and the motor seat (31) letting the motor shaft (32) be disposed at the bottom; a vane wheel room (26) for setting therein of the vane wheel (4) and the shell (5) letting the vane wheel be fixedly mounted on the motor shaft (32) of the motor (3) through the center hole (41) and be covered with the shell (5); a filter room (27) below the vane wheel room (26) for setting therein of the filter case (6); and a draft chamber (28) vertically set at one side to communicate the bottom elongated draft holes (29) to the top air outlet hole (23). The flexible air pipe (8) is having a connecting end (81) for connection of the pipe (8) to the air outlet hole (23) by means of sleeve joint, and having a curved air outlet hole (82) set at the opposite end.

Figure 3:
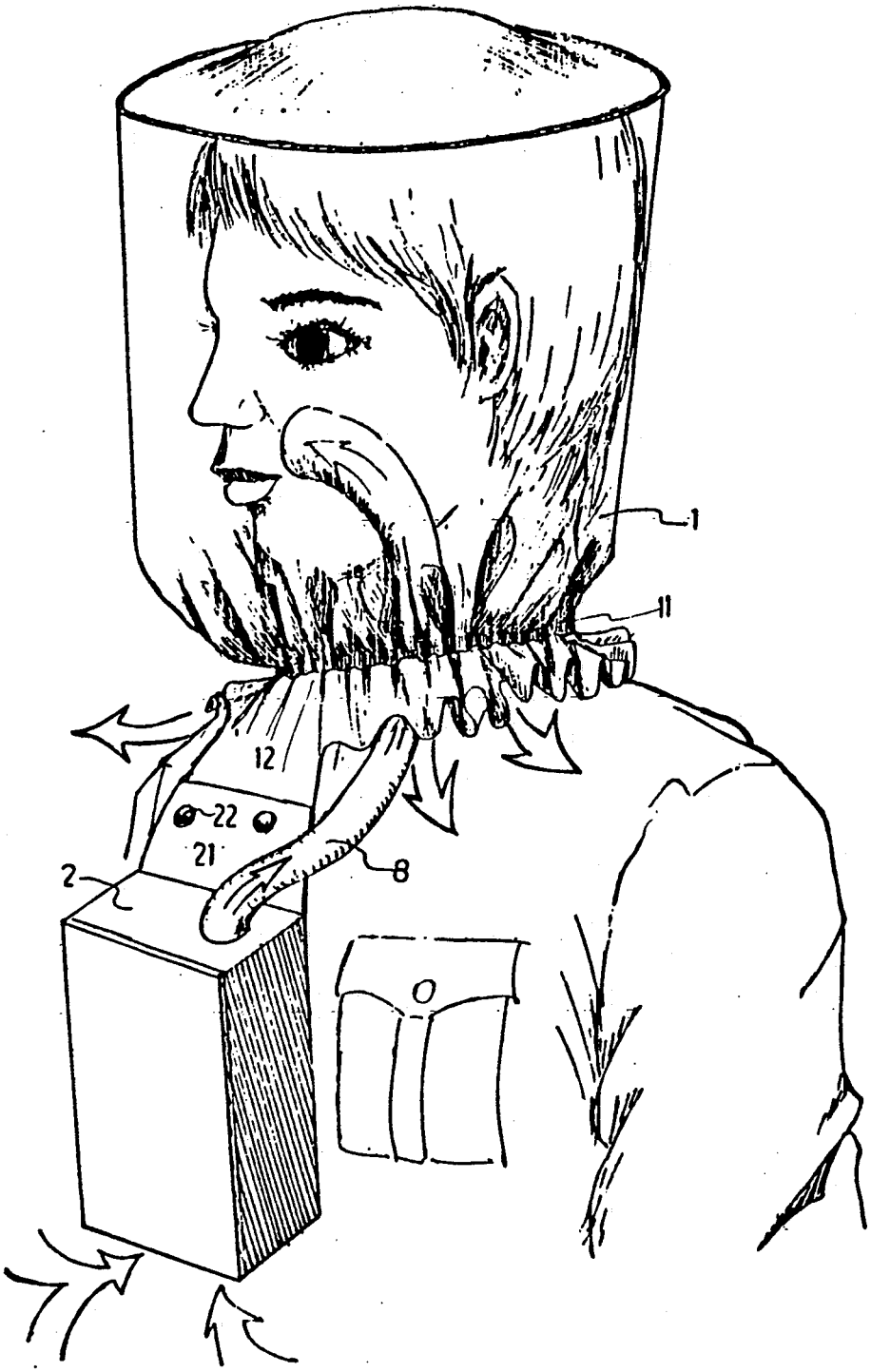
FIG. 3 is a schematic drawing illustrating the use of the present invention.

When in operation, as shown in FIG. 3, the batteries (7) provide the motor (3) with working power to drive the vane wheel (4) to rotate so as to exhaust in the outside air to let the air pass through the filter case (6) for filtration. The filtered air is further delivered through the draft chamber (28) and air outlet hole (23) into the air pipe, such that the user can respire clean air from the curved air outlet hole (82). Because the elastic band (11) provides flexible fastening effect, the exhalation from the user is exhausted through the bottom opening of the transparent cover (1).

Figure 4:
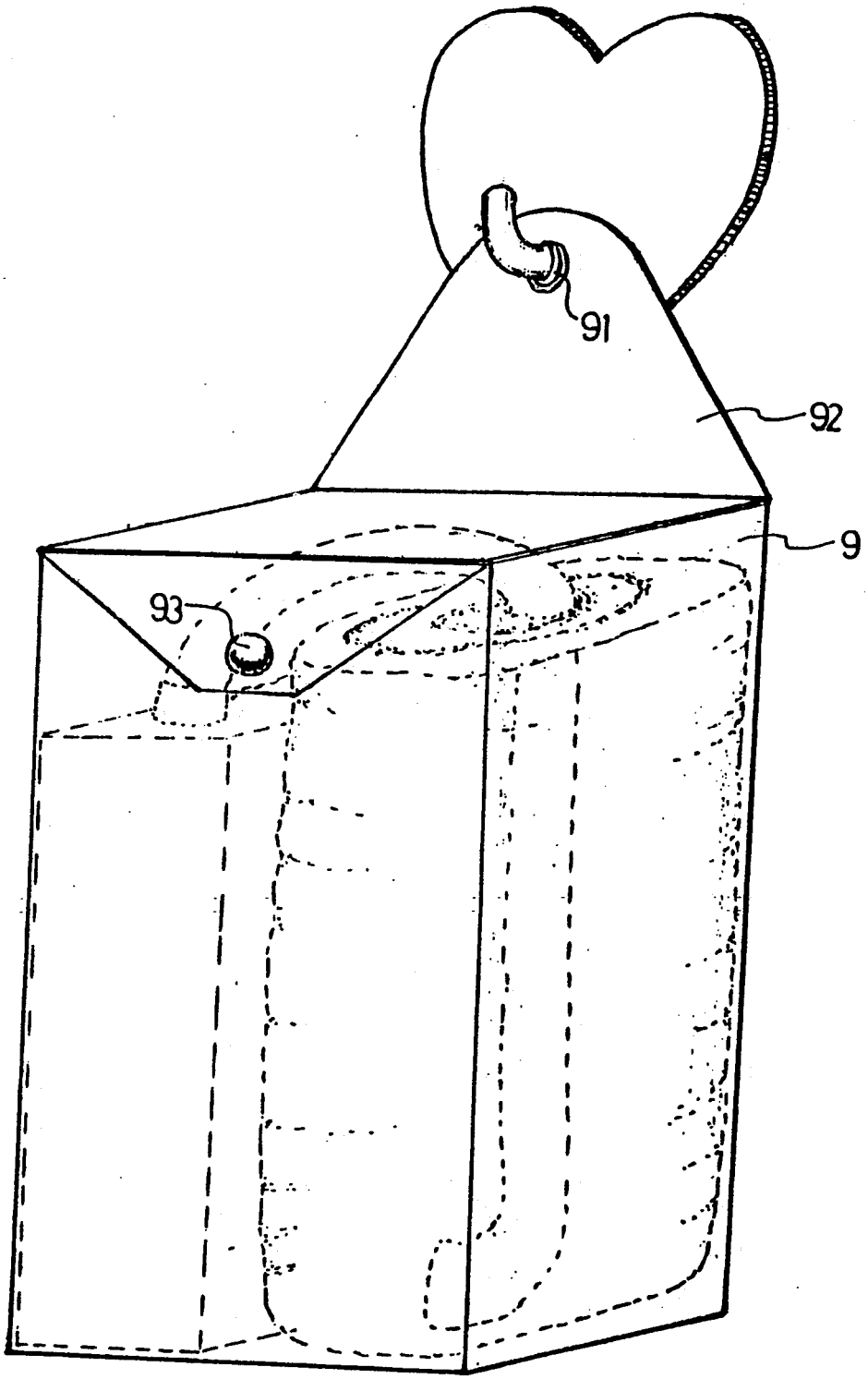
FIG. 4 is a schematic drawing illustrating the present invention in a collected condition.

When not in use, as shown in FIG. 4, the transparent cover (1) is folded up through the notches (16) and received in a protective case (9). The protective case (9) is having a hanging a flap (92) with a round hole (91) made thereon for suspension of the protective case (9) from a hanger or the like which is fixedly mounted on the wall at a visible and normal accessible place. The protective case (9) is having a cover with a fastener means (93) made thereon to cover the top opening of the case so as to protect the closed inner space when the transparent cover (1) is set therein. Because the present invention minimizes space consumption, it is very convenient to carry with the oneself when one is performing high risk job.

In conclusion, the present invention is to provide a simple gas mask for use in emergent case, which is having numerous features each of which tends to make the structure more practical in use and more easy to operate.

What is claimed is:

1. A first-aid gas mask including a transparent cover, for enclosing the head of a wearer; an air filter and a flexible air pipe, wherein said transparent cover is comprised of a rigid ring having two oppositely positioned notches thereon to permit folding of said transparent cover, and said cover being made of soft transparent and heat resisting material having a bottom end and an opening therein with an elastic band thereon for fastening around the neck of a wearer, said cover further comprising a rectangular flap extending downward from the bottom end, said rectangular flap having two male snap fasteners thereon and said air filter being comprised of a rectangular case including a flap with two female snap fasteners thereon to fasten with the two male snap fasteners on said rectangular flap, said rectangular case having a top and a bottom and an inner space divided into battery chamber for setting therein of four batteries; a motor room below said battery chamber for a motor and a motor seat with a motor shaft disposed at the bottom; a vane wheel room for containing a vane wheel and a shell, said vane wheel being fixedly mounted on said motor shaft of said motor and covered by said shell; a filter room below said vane wheel room for containing a filter case, the filter case having active carbon arranged thereinside and a draft chamber vertically set at one side, and elongated draft holes at the bottom of said case, said draft holes communicating with said draft chamber, and an air outlet hole at the top of said case, and wherein said flexible air pipe having one end connected to the air outlet hole of said air filter and having the other end inserted into said transparent cover and disposed at the nose and mouth area of the user who puts on the present gas mask, to provide the user with clean air; and wherein said batteries provide said motor with working power to drive said vane wheel to rotate so as to bring in outside air through said filter case for filtration, and to let the filtrated clean air be delivered through said flexible air pipe to the user for inhalation.

* * * * *